US006152830A

United States Patent [19]

Archie

[11] Patent Number: 6,152,830

[45] Date of Patent: Nov. 28, 2000

[54] PUTTING PRACTICE SYSTEM

[76] Inventor: Samuel L. J. Archie, 217 Fleur De Lis Dr., Slidell, La. 70460

[21] Appl. No.: 09/325,310

[22] Filed: Jun. 3, 1999

[51] Int. Cl.[7] ..... A63B 69/36

[52] U.S. Cl. ..... 473/160; 473/153; 473/162; 473/163; 473/171; 473/181; 473/184; 473/192

[58] Field of Search ..... 473/150–167, 473/171, 172, 174, 180, 181, 182, 184, 185, 190–192, 194, 195

[56] References Cited

U.S. PATENT DOCUMENTS

| | | | |
|---|---|---|---|
| 1,856,816 | 5/1932 | Luddy . | |
| 3,735,988 | 5/1973 | Palmer et al. | 473/162 |
| 3,944,232 | 3/1976 | Tierney | 273/176 |
| 3,990,573 | 11/1976 | Cross | 206/315 |
| 4,114,887 | 9/1978 | DelRaso | 473/161 |
| 4,647,046 | 3/1987 | Hurt | 273/176 |
| 5,002,280 | 3/1991 | Hines | 273/176 |
| 5,042,813 | 8/1991 | Huang | 273/182 |
| 5,067,716 | 11/1991 | Namanny et al. | 273/176 |
| 5,108,101 | 4/1992 | Postula | 273/176 |
| 5,171,016 | 12/1992 | Kamal | 273/176 |
| 5,301,947 | 4/1994 | Kim | 473/163 |
| 5,429,368 | 7/1995 | Adams | 273/192 |
| 5,441,266 | 8/1995 | Cedrone | 273/176 |
| 5,655,971 | 8/1997 | Wayne | 473/163 |
| 5,690,557 | 11/1997 | Casillas et al. | 473/265 |
| 6,056,645 | 5/2000 | Servatius | 473/161 |

*Primary Examiner*—Mark S. Graham
*Attorney, Agent, or Firm*—Joseph N. Breaux

[57] ABSTRACT

A putting practice system for aiding golfers in maintaining putting skill levels. The practice system includes a surface contour that is adaptable by a user by inflating one or more air bladders to offer putting challenges not provided by a smooth even putting surface.

1 Claim, 1 Drawing Sheet

PUTTING PRACTICE SYSTEM

TECHNICAL FIELD

The present invention relates to putting systems and more particularly to a putting practice system that includes a cup end putting surface member, a forward end putting surface member hingedly attached to the cup end putting surface member with a hinge, left and right stance platform members detachably connectable to the left and right sides of the forward end putting surface member, and a detachable electronic score keeping display attachable to the cup end putting surface member; the cup end putting surface member including a rigid cup end base structure member having slanted ball return capture channel along the back end thereof, a ball return pipe running from a lowest point of the ball return capture channel to a ball transfer opening formed through the front end of the cup end putting surface member, a cup end putting surface fabric with a resilient backing attached to and covering the upper surface of the rigid cup end base structure member, a ball cup formed through the cup end putting surface fabric and the rigid cup end base structure member into connection with the ball return pope at a location between the ball return capture channel and the front end of the cup end putting surface member, and inflatable bladder assembly having an inflatable bladder positioned between the cup end putting surface fabric and the rigid cup end base structure member at a location between the ball cup and the front end of the cup end putting surface member and an inflation mechanism including an inflation tube routed through the rigid cup end base structure member to a bulb inflation mechanism attached to an exterior sidewall of the cup end putting surface member, a first ball passage sensor for detecting passage of a golf ball through the cup hole and generating a first ball sensor passage signal to a first output display socket connector formed into the back end of cup end putting surface member, and a second ball passage sensor positioned to detect passage of a golf ball through a section of the ball return pipe running between the ball return capture channel and the ball cup and generating a second ball sensor passage signal to a second output display socket connector formed into the back end of cup end putting surface member; the detachable electronic score keeping display having first and second signal receiving plugs that are each, respectively, insertable into one of the first and second output display socket to electrically connect the electronic score keeping display to the first and second ball passage sensors, the electronic score keeping display having a display output for displaying the number of balls detected by each of the first and second ball passage sensors; the forward surface member having a rigid forward end base structure supporting a forward end putting surface fabric attached to an upper surface thereof and including a hinge end hingedly attached to the rigid cup end base structure member, the rigid forward end base structure having a return channel formed therein along an end thereof opposite the hinge end, a forward end ball return tube running from the hinge end in registration with the ball transfer opening of the ball return pipe to the return channel, and two pairs of stance platform alignment and connecting dowel receiving bores, each pair being formed into one of the left and right side surfaces thereof; the left and right stance platform members each including a rigid stance platform base structure having a stance platform putting surface attached thereof and a pair of alignment and connecting dowels sized to simultaneously fractionally fit into a pair of the stance platform alignment and connecting dowel receiving bores in a manner such that the stance platform putting surface is coplanar with the forward end putting surface fabric; the forward end putting surface member being hingedly attached to the cup end putting surface member such that at the point of juncture thereof the cup end putting surface fabric is coplanar with the forward end putting surface fabric.

BACKGROUND ART

To maintain putting skill levels, it is often desirable to practice putting on an artificial putting surface when the golfer is unable to play frequently enough to maintain his/her putting skills at the desired level. It would be desirable, therefore, to have a putting practice system that could be used by a golfer to help maintain putting skill levels. In addition, because putting is typically not performed on a flat even surface when playing golf, it would desirable if the putting practice system included a putting surface having a surface contour adaptable by a user by inflating one or more air bladders to offer putting challenges not provided by a smooth even putting surface.

GENERAL SUMMARY DISCUSSION OF INVENTION

It is thus an object of the invention to provide a putting practice system that includes a cup end putting surface member, a forward end putting surface member hingedly attached to the cup end putting surface member with a hinge, left and right stance platform members detachably connectable to the left and right sides of the forward end putting surface member, and a detachable electronic score keeping display attachable to the cup end putting surface member; the cup end putting surface member including a rigid cup end base structure member having slanted ball return capture channel along the back end thereof, a ball return pope running from a lowest point of the ball return capture channel to a ball transfer opening formed through the front end of the cup end putting surface member, a cup end putting surface fabric with a resilient backing attached to and covering the upper surface to the rigid cup end base structure member, a ball cup formed through the cup end putting surface fabric and the rigid cup end base structure member into connection with the ball return pipe at a location between the ball return capture channel and the front end of the cup end putting surface member, an inflatable bladder assembly having an inflatable bladder positioned between the cup end putting surface fabric and the rigid cup end base structure member at a location between the ball cup and the front end of the cup end putting surface member and an inflation mechanism including an inflation tube routed through the rigid cup end base structure member to a bulb inflation mechanism attached to an exterior sidewall of the cup end putting surface member, a first ball passage sensor for detecting passage of a golf ball through the cup hole and generating a first ball sensor passage signal to a first output display socket connector formed into the back end of cup end putting surface member, and a second ball passage sensor positioned to detect passage of a golf ball through a section of the ball return pipe running between the ball return capture channel and the ball cup and generating a second ball sensor passage signal to a second output display socket connector formed into the back end of cup end putting surface member; the detachable electronic score keeping display having first and second signal receiving plugs that are each, respectively, insertable into one of the first and second output display sockets to electrically connect the electronic score keeping display to the first and second ball passage sensors, the electronic score keeping display having a display output for displaying the number of balls detected by each of the first and second ball passage sensors; the forward putting surface member having a rigid forward end base structure supporting a forward end putting surface fabric attached to and upper surface thereof and including a hinge end hingedly attached to the rigid cup end base structure member, the rigid forward end base structure having a return channel formed therein along an end thereof opposite the hinge end, a forward end ball return tube running from the hinge end in registration with the ball transfer opening of the ball return pipe to the return channel, and two pairs of stance platform alignment and connecting dowel receiving bores, each pair being formed into one of the left and right side surfaces thereof; the left and right stance platform members each including a rigid stance platform base structure having a stance platform putting surface attached thereof and a pair of alignment and connecting dowels sized to simultaneously frictionally fit into a pair of the stance platform alignment and connecting dowel receiving bores in a manner such that the stance platform putting surface is coplanar with the forward end putting surface fabric; the forward end putting surface member being hingedly attached to the cup end putting surface member such that at the point of juncture thereof the cup end putting surface fabric is coplanar with the forward end putting surface fabric.

Accordingly, a putting practice system is provided. The putting practice system includes a cup end putting surface member, a forward end putting surface member hingedly attached to the cup end putting surface member with a hinge, left and right stance platform members detachably connectable to the left right sides of the forward end putting surface member, and a detachable electronic score keeping display attachable to the cup end putting surface member; the cup end putting surface member including a rigid cup end base structure member having slanted ball return capture channel along the back end thereof, a ball return pipe running from a lowest point of the ball return capture channel to a ball transfer opening formed through the front end of the cup end putting surface member, a cup end putting surface fabric with a resilient backing attached to and covering the upper surface of the rigid cup end base structure member, a ball cup formed through the cup end putting surface fabric and the rigid cup end base structure member into connection with the ball return pipe at a location between the ball return capture channel and the front end of the cup end putting surface member, an inflatable bladder assembly having an inflatable bladder positioned between the cup end putting surface fabric and the rigid cup end base structure member at a location between the ball cup and the front end of the cup end putting surface member and an inflation mechanism including an inflation tube routed through the rigid cup end base structure member to a bulb inflation mechanism attached to an exterior sidewall of the cup end putting surface member, a first ball passage sensor for detecting passage of a golf ball through the cup hole and generating a first ball sensor passage signal to a first output display socket connector formed into the back end of cup end putting surface member, and a second ball passage sensor positioned to detect passage of a golf ball through a section of the ball return pipe running between the ball return capture channel and the ball cup and generating a second ball sensor passage signal to a second output display socket connector formed into the back end of cup end putting surface member; the detachable electronic score keeping display having first and second signal receiving plugs that are each, respectively, insertable into one of the first and second output display sockets to electrically connect the electronic score keeping display to the first and second ball passage sensors, the electronic score keeping display having a display output for displaying the number of balls detected by each of the first and second ball passage sensors; the forward putting surface member having a rigid forward end base structure supporting a forward end putting surface fabric attached to an upper surface thereof and including a hinge end hingedly attached to the rigid cup end base structure member, the rigid forward end base structure having a return channel formed therein along an end thereof opposite the hinge end, a forward end ball return tube running from the hinge end in registration with the ball transfer opening of the ball return pipe to the return channel, and two pairs of stance platform alignment and connecting dowel receiving bores, each pair being formed into one of the left and right side surfaces thereof; the left and right stance platform members each including a rigid stance platform base structure having a stance platform putting surface attached thereto and a pair of alignment and connecting dowels sized to simultaneously frictionally fit into a pair of the stance platform alignment and connecting dowel receiving bores in a manner such that the stance platform putting surface is coplanar with the forward end putting surface fabric; the forward end putting surface member being hingedly attached to the cup end putting surface member such that at the point of juncture thereof the cup end putting surface fabric is coplanar with the forward end putting surface fabric.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
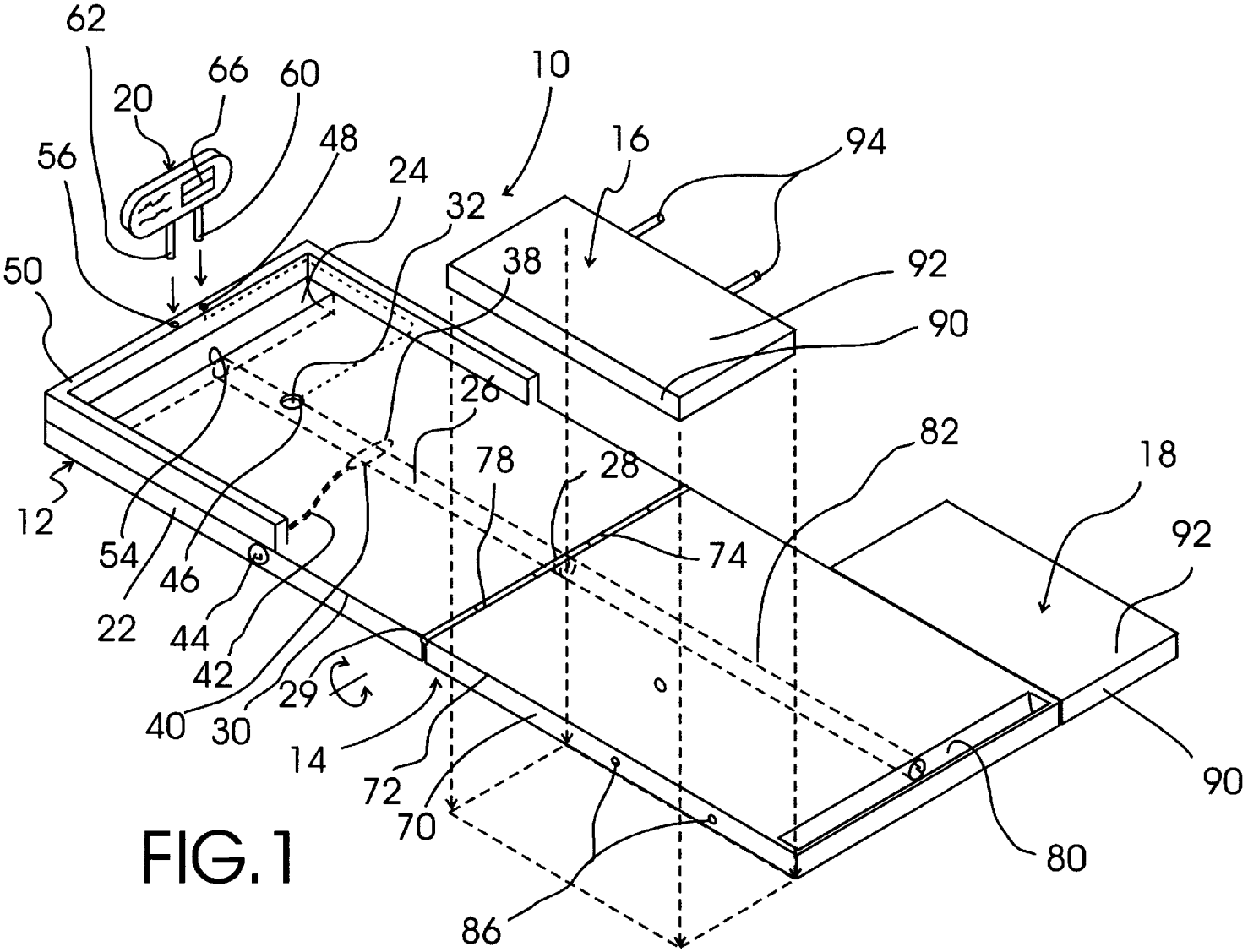
FIG. 1 is a perspective view of an exemplary embodiment of the putting practice system of the present invention showing the cup end putting surface member, the forward end putting surface member hingedly attached to the cup end putting surface member with a hinge, left and right stance platform members detachably connectable to left and right sides of the forward end putting surface member, and a detachable electronic score keeping display attachable to the cup end putting surface member; the cup end putting surface member including a rigid cup end base structure member having slated ball return capture channel along the back end thereof, a ball return pipe running from a lowest point of the ball return capture channel to a ball transfer opening formed through the front end of the cup end putting surface member, a cup end putting surface fabric with a resilient backing attached to and covering the upper surface of the rigid cup end base structure member, a ball cup formed through the cup end putting surface fabric and the rigid cup end base structure member into connection with the ball return pipe at a location between the ball return capture channel and the front end of the cup end putting surface member, an inflatable bladder assembly having an inflatable bladder positioned between the cup end putting surface fabric and the rigid cup end base structure member at a location between the ball cup and the front end of the cup end putting surface member and an inflation mechanism including an inflation tube routed through the rigid cup end base structure member to a bulb inflation mechanism attached to an exterior sidewall of the cup end putting surface member, a first ball passage sensor for detecting passage of a golf ball through the cup hole and generating a first ball sensor passage signal to a first output display socket connector formed into the back end of cup end putting surface member, and a second ball passage sensor positioned to detect passage of a golf ball through a section of the ball return pipe running between the ball return capture channel and the ball cup and generating a second ball sensor passage signal to a second output display socket connector formed into the back end of cup end putting surface member; the detachable electronic score keeping display having first and second signal receiving plugs that are each, respectively, insertable into one of the first and second output display sockets to electrically connect the electronic score keeping display to the first and second ball passage sensors, the electronic score keeping display having a display output for displaying the number of balls detected by each of the first and second ball passage sensors; the forward putting surface member having a rigid forward end base structure supporting a forward end putting surface fabric attached to an upper surface thereof and including a hinge end hingedly attached to the rigid cup end base structure member, the rigid forward end base structure having a return channel formed therein along an end thereof apposite the hinge end, a forward end ball return tube running from the hinge end in registration with the ball transfer opening of the ball return pipe to the return channel, and two pairs of stance platform alignment and connecting dowel receiving bores, each pair being formed into one of the left and right side surfaces thereof; the left and right stance platform members each including a rigid stance platform base structure having a stance platform putting surface attached thereto and a pair of alignment and connecting dowels sized to simultaneously frictionally fit into a pair of the stance platform alignment and connecting dowel receiving bores in a manner such that the stance platform putting surface is coplanar with the forward end putting surface fabric; the forward end putting surface member being hingedly attached to the cup end putting surface member such that at the point of juncture thereof the cup end putting surface fabric is coplanar with the forward end putting surface fabric.

FIG. 1 shows an exemplary embodiment of the putting practice system of the present invention generally designated 10. Putting practice system 10 includes a cup end putting surface member, generally designated 12; a forward end putting surface member, generally designated 14; left and right stance platform members, generally designated 16,18; and a detachable electronic score keeping display, generally designated 20.

Cup and putting surface member 12 includes a rigid cup end base structure member 22 having a slanted ball return capture channel 24 formed along the back end thereof, a ball return pipe 26 (shown in dashed lines) running form a lowest point of ball return capture channel 24 to a ball transfer opening 28 formed through a front end 29 of cup end putting surface member 12, a cup end putting surface fabric 30 with a resilient backing attached to and covering the upper surface of rigid cup end base structure member 22, a ball cup 32 formed through cup end putting surface fabric 30 and rigid cup end base structure member 22 into connection with ball return pipe 26 at a location between ball return capture channel 24 and front end 29 of cup end putting surface member 12, an inflatable bladder assembly, generally designated 38, having an inflatable bladder 40 (shown in dashed lines) positioned between cup end putting surface fabric 30 and rigid cup end base structure member 22 at a location between ball cup 32 and the front end 29 of cup end putting surface member 12 and an inflation mechanism including an inflation tube 42 (shown in dashed lines) routed through rigid cup end base structure 22 to a bulb inflation mechanism 44 attached to an exterior sidewall of cup end putting surface member 12, a first ball passage sensor 46 for detecting passage of a golf ball through cup hole 32 and generating a first ball sensor passage signal to a first output display socket connector 48 formed into the back end 50 of cup end putting surface member 12, and a second ball passage sensor 54 position detect passage of a golf ball through a section of the ball return pipe 26 running between the ball return capture channel 24 and ball cup 32 and generating a second ball sensor passage signal to a second output display socket connector 56 formed into back end 50 of cup end putting surface member 12. In use, inflatable bladder 40 is inflated to the desired magnitude to allow the user to generate different practice contours on cup end putting surface member 12.

Detachable electronic score keeping display 20 has first and second signal receiving plugs 60,62 that are each, respectively, insertable into one of the first and second output display sockets 48,56, to electrically connect electronic score keeping display 20 to first and second ball passage sensors 46,54. Electronic score keeping display 20 has a display output 66 for displaying the number of balls detected by each of the first and second ball passage sensors 46,54.

Forward putting surface member 14 has a rigid forward end base structure 70 supporting a forward end putting surface fabric 72 attached to an upper surface thereof and includes a hinge end 74 hingedly attached to rigid cup end base structure member 22 with piano hinge 78. Rigid forward end base structure 70 has a return channel 80 formed therein along an end thereof opposite hinge end 74, a forward end ball return tube 82 (shown in dashed lines) running from hinge end 74 in registration with ball transfer opening 28 of ball return pipe 26 to return channel 80, and two pairs of stance platform alignment and connecting dowel receiving bores 86 (only one pair shown). Each pair of receiving bores 86 is formed into one of the left and right side surfaces of rigid forward end base structure 70. Left and right stance platform members 16,18 each include a rigid stance platform base structure 90 having a stance platform putting surface 92 attached thereto and a pair of alignment and connecting dowels 94 sized to simultaneously frictionally fit into a pair of the stance platform alignment and connecting dowel receiving bores 86 in a manner such that the stance platform putting surface 92 is coplanar with forward end putting surface fabric 72. Forward end putting surface member 14 is hingedly attached to cup end putting surface member 12 such that at the point of juncture thereof cup end putting surface fabric 30 is coplanar with forward end putting surface fabric 72.

It can be seen from the preceding description that a putting practice system has been provided that includes a cup end putting surface member, a forward end putting surface member hingedly attached to the cup end putting surface member with a hinge, left and right stance platform members detachably connectable to the left and right sides of the forward end putting surface member, and a detachable electronic score keeping display attachable to the cup end putting surface member; the cup end putting surface member including a rigid cup end base structure member having slanted ball return capture channel along the back end thereof, a ball return pipe running from a lowest point of the ball return capture channel to a ball transfer opening formed through the front end of the cup end putting surface member, a cup end putting surface fabric with a resilient backing attached to and covering the upper surface of the rigid cup end base structure member, a ball cup formed through the cup end putting surface fabric and the rigid cup end base structure member into connection with the ball return pipe at a location between the ball return capture channel and the front end of the cup end putting surface member, an inflatable bladder assembly having an inflatable bladder positioned between the cup end putting surface fabric and the rigid cup end base structure member at a location between the ball cup and the front end of the cup end putting surface member and an inflation mechanism including an inflation tube routed through the rigid cup end base structure member to a bulb inflation mechanism attached to an exterior sidewall of the cup end putting surface member, a first ball passage sensor for detecting passage of a golf ball through the cup hole and generating a first ball sensor passage signal to a first output display socket connector formed into the back end of a cup end putting surface member, and a second ball passage sensor positioned to detect passage of a golf ball through a section of the ball return pipe running between the ball return capture channel and the ball cup and generating a second ball sensor passage signal to a second output display socket connector formed into the back end of cup end putting surface member; the detachable electronic score keeping display having first and second signal receiving plugs that are each, respectively, insertable into one of the first and second output display sockets to electrically connect the electronic score keeping display to the first and second ball passage sensors, the electronic score keeping display having a display output for displaying the number of balls detected by each of the first and second ball passage sensors; the forward putting surface member having a rigid forward end base structure supporting a forward end putting surface fabric attached to an upper surface thereof and including a hinge end hingedly attached to the rigid cup end base structure member, the rigid forward end base structure having a return channel formed therein along an end throf opposite the hinge end, a forward end ball return tube running from the hinge end in registration with the ball transfer opening of the ball return pipe to the return channel, and two pairs of stance platform alignment and connecting dowel receiving bores, each pair being formed into one of the left and right side surfaces thereof; the left and right stance platform members each including a rigid stance platform base structure having a stance platform putting surface attached thereto and a pair of alignment and connecting dowels sized to simultaneously frictionally fit into a pair of the stance platform alignment and connecting dowel receiving bores in a manner such that the stance platform putting surface is coplanar with the forward end putting surface fabric; the forward end putting surface member being hingedly attached to the cup end putting surface member such that at the point of juncture thereof the cup end putting surface fabric is coplanar with the forward end putting surface fabric.

It is noted that the embodiment of the putting practice system described herein in detail for exemplary purposes is of course subject to many different variations in structure, design, application and methodology. Because many varying and the different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A putting practice system comprising:

a cup end putting surface member;

a forward end putting surface member hingedly attached to said cup end putting surface member with a hinge;

left and right stance platform members detachably connectable to left and right sides of said forward end putting surface member; and a detachable electronic score keeping display attachable to said cup end putting surface member;

said cup end putting surface member including a rigid cup end base structure member having a slanted ball return capture channel along a back end thereof, a ball return pipe running from a lowest point of said ball return capture channel to a ball transfer opening formed through a front end of said cup end putting surface member, a cup end putting surface fabric with a resilient backing attached to and covering an upper surface of said rigid cup end base structure member, a ball cup formed through said cup end putting surface fabric and said rigid cup end base structure member into connection with said ball return pipe at a location between said ball return capture channel and said front end of said cup end putting surface member, an inflatable bladder assembly having an inflatable bladder positioned between said cup end putting surface fabric and said rigid cup end putting surface member at a location between said ball cup and said front end of said cup end putting surface member and an inflation mechanism including an inflation tube routed through said rigid cup end base structure member to a bulb inflation mechanism attached to an exterior sidewall of said cup end putting surface member, a first ball passage sensor for detecting passage of a golf ball through said cup hole and generating a first ball sensor passage signal to a first output display socket connector formed into said back end of cup end putting surface member, and a second ball passage sensor positioned to detect passage of a golf ball through a section of said ball return pipe running between said ball return capture channel and said ball cup and generating a second ball sensor passage signal to a second output display socket connector formed into said back end of cup end putting surface member;

said detachable electronic score keeping display having first and second signal receiving plugs that are each, respectively, insertable into one of said first and second output display sockets to electrically connect said electronic score keeping display to said first and second ball passage sensors, said electronic score keeping display having a display output for displaying said number of balls detected by each of said first and second ball passage sensors;

said forward putting surface member having a rigid forward end base structure supporting a forward end putting surface fabric attached to an upper surface thereof and including a hinge end hingedly attached to said rigid cup end base structure member, said rigid forward end base structure having a return channel formed therein along an end thereof opposite said hinge end, a forward end ball return tube running from said hinge end in registration with said ball transfer opening of said ball return pipe to said return channel, and two pairs of stance platform alignment and connecting dowel receiving bores, each pair being formed into one of said left and right side surfaces thereof;

said left and right stance platform members each including a rigid stance platform base structure having a stance platform putting surface attached thereto and a pair of alignment and connecting dowels sized to simultaneously frictionally fit into a pair of said stance platform alignment and connecting dowel receiving bores in a manner such that said stance platform putting surface is coplanar with said forward end putting surface fabric;

said forward end putting surface member being hingedly attached to said cup end putting surface member such that at said point of juncture thereof said cup end putting surface fabric is coplanar with said forward end putting surface fabric.

* * * * *